US008976996B2

(12) United States Patent
Ku et al.

(10) Patent No.: US 8,976,996 B2
(45) Date of Patent: Mar. 10, 2015

(54) ARRAY SPEAKER STRUCTURE FOR AUDIO/VIDEO DEVICE

(75) Inventors: Ting-shuo Ku, Taipei (TW); Che-Ming Liang, Taipei (TW); Jui-Hsiang Hsiao, Taipei (TW)

(73) Assignee: Arima Communitions Corp., Taipei (TW)

( * ) Notice: Subject to any disclaimer, the term of this patent is extended or adjusted under 35 U.S.C. 154(b) by 428 days.

(21) Appl. No.: 13/550,931

(22) Filed: Jul. 17, 2012

(65) Prior Publication Data

US 2014/0023220 A1 Jan. 23, 2014

(51) Int. Cl.
*H04R 1/02* (2006.01)
*H04R 5/02* (2006.01)

(52) U.S. Cl.
USPC ..... 381/388; 381/333; 381/395

(58) Field of Classification Search
USPC ..... 381/306, 333, 386, 387, 388, 395; 181/141, 199; 361/679.23
See application file for complete search history.

(56) References Cited

U.S. PATENT DOCUMENTS

| | | | | |
|---|---|---|---|---|
| 5,675,426 | A * | 10/1997 | Meisner et al. | 348/838 |
| 6,151,401 | A * | 11/2000 | Annaratone | 381/388 |
| 6,181,550 | B1 * | 1/2001 | Kim | 361/679.06 |
| 2007/0274547 | A1 * | 11/2007 | Ueno | 381/306 |
| 2008/0220812 | A1 * | 9/2008 | Wang | 455/550.1 |

* cited by examiner

*Primary Examiner* — Tuan D Nguyen
(74) *Attorney, Agent, or Firm* — Muncy, Geissler, Olds & Lowe, P.C.

(57) ABSTRACT

An array speaker structure for audio/video device includes a slide contact assembly by means of which an array speaker unit is movable out of the audio/video device from a retracted position to an extended position. The slide contact assembly is connected with a connector. By means of operating and 180-degree rotating the connector, the speakers of the array speaker unit can be rotatable to a front side of the audio/video device. Then the array speaker unit is lifted and attached to a lateral side of the audio/video device, whereby the speakers can emit sound from the front side of the audio/video device.

10 Claims, 10 Drawing Sheets

ARRAY SPEAKER STRUCTURE FOR AUDIO/VIDEO DEVICE

BACKGROUND OF THE INVENTION

1. Field of the Invention

The present invention relates generally to an array speaker structure for audio/video device, and more particularly to an array speaker structure in which the array speaker unit can be extended out of the audio/video device and then rotated and lifted to make the speakers of the array speaker unit emit sound from a front side of the audio/video device.

2. Description of the Related Art

It is known that tablet personal computer (shortened to tablet PC, tablet or slate) is a kind of miniaturized personal computer, which is convenient to carry. The tablet has a touch screen as a main input unit. The tablet is free from the conventional keyboard and mouse and allows a user to operate the touch screen in a handwritten or touch manner. In comparison with the current laptop, PDA and intelligent cellular phone, the tablet has the advantages of lightweight and larger screen and is obviously another convenient option of the consumers.

However, in consideration of miniaturization and convenient carriage, the convenient tablet often employs small-power speakers to accommodate the lightweight and slim design of the tablet. The small-power speakers can only emit sound at lower sound quality and volume. In the case that it is desired to enhance the audio effect, generally the tablet can be only connected to external speakers. This is totally not in conformity with the design object of the tablet.

In general, the speaker units of the loudspeaker system of the conventional tablet are fixedly disposed on left and right sides of the screen to provide left and right channels and create a stereo sound effect. However, as aforesaid, in consideration of miniaturization and convenient carriage, the convenient tablet often employs small-power speakers to accommodate the lightweight and slim design of the tablet. Therefore, the sound can be only emitted at lower sound quality and volume. In the case that it is desired to enhance the audio effect, generally the tablet can be only connected to external speakers. This is totally not in conformity with the design object of the tablet.

In addition, some tablets can provide portable digital audio/video entertainment function for a user. However, with the small-power speakers, the sound effect needs to be enhanced. In the case that the volume is turned up or the speakers are used in a megabass mode, distortion is likely to take place. As a result, the sound cannot be widely broadcast to achieve a good listening quality.

SUMMARY OF THE INVENTION

It is therefore a primary object of the present invention to provide an array speaker structure for audio/video device. By means of a slide contact assembly, the array speaker unit of the array speaker structure can be extended out of the audio/video device. Then the array speaker unit can be rotated and lifted to make the speakers of the array speaker unit face a front side of the audio/video device. In this case, the speakers can emit sound from the front side of the audio/video device.

To achieve the above and other objects, the array speaker structure for audio/video device of the present invention includes a slide contact assembly movable from a first position to a second position within an interior of the audio/video device along a longitudinal direction thereof. The slide contact assembly includes a pair of conductive members in electrical connection with the audio/video device. The slide contact assembly further includes a first conductive assembly having an inner sleeve, an outer sleeve, a first inner conductive ring coaxially disposed around the inner sleeve and a first outer conductive ring coaxially disposed in the outer sleeve. The first inner conductive ring and the first outer conductive ring are respectively electrically connected to the conductive members. The array speaker structure further includes a connector, which can be 180-degree rotated. The connector includes a second conductive assembly including a second inner conductive ring positioned around the first inner conductive ring in electrical contact therewith and a second outer conductive ring positioned in the first outer conductive ring in electrical contact therewith. The connector further includes a pair of conductive plates respectively electrically connected to the second inner conductive ring and the second outer conductive ring. The array speaker structure further includes an array speaker unit. A pair of leaf springs is disposed on the array speaker unit in electrical contact with the pair of conductive plates of the connector.

BRIEF DESCRIPTION OF THE DRAWINGS

The structure and the technical means adopted by the present invention to achieve the above and other objects can be best understood by referring to the following detailed description of the preferred embodiment and the accompanying drawings, wherein.

DETAILED DESCRIPTION OF THE PREFERRED EMBODIMENT

Figure 1:
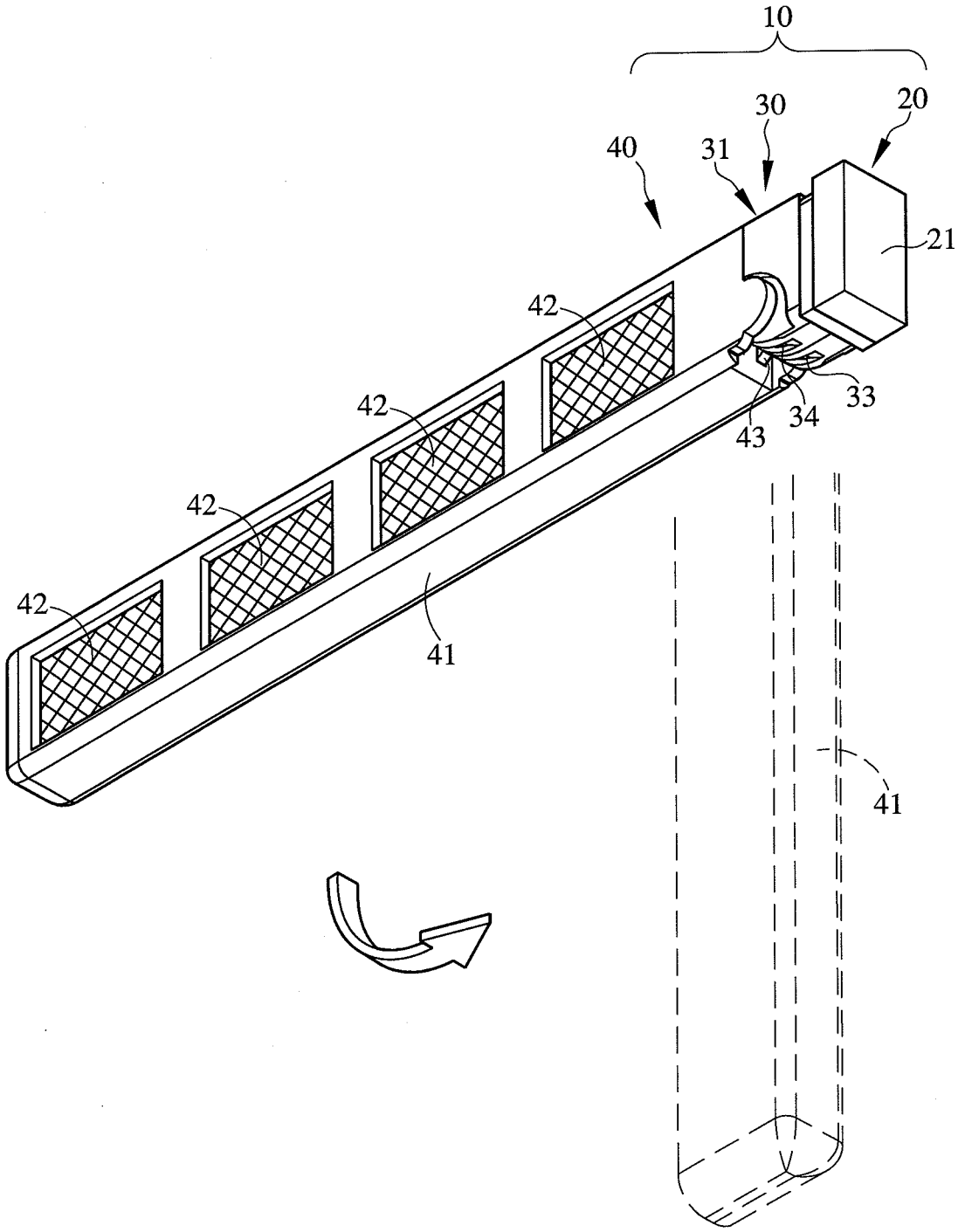
FIG. 1 is a perspective view of the array speaker structure of the present invention.
Figure 2:
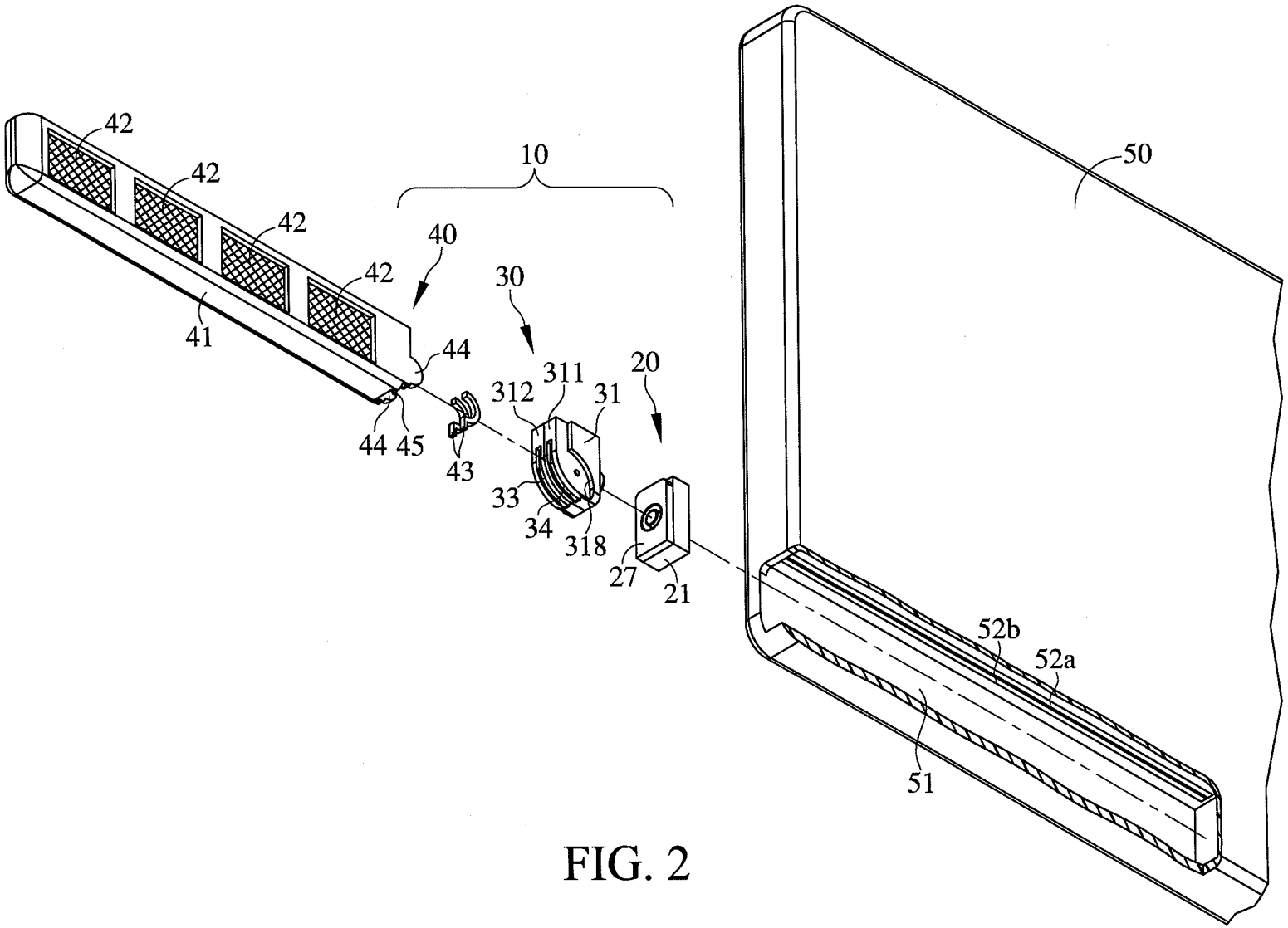
FIG. 2 is a perspective exploded view of the array speaker structure of the present invention, showing the position relationship between the array speaker structure and a tablet.

Please refer to FIGS. 1 and 2. The array speaker structure 10 of the present invention is slidably installed in a slide passage 51 of a bottom section of an audio/video device such as a tablet 50. Two conductive strips 52*a*, 52*b* are disposed on an upper end face of the slide passage 51 in electrical connection with interior circuit board of the tablet 50. The array speaker structure 10 of the present invention includes a slide contact assembly 20, a connector 30 and an array speaker unit 40.

Figure 3:
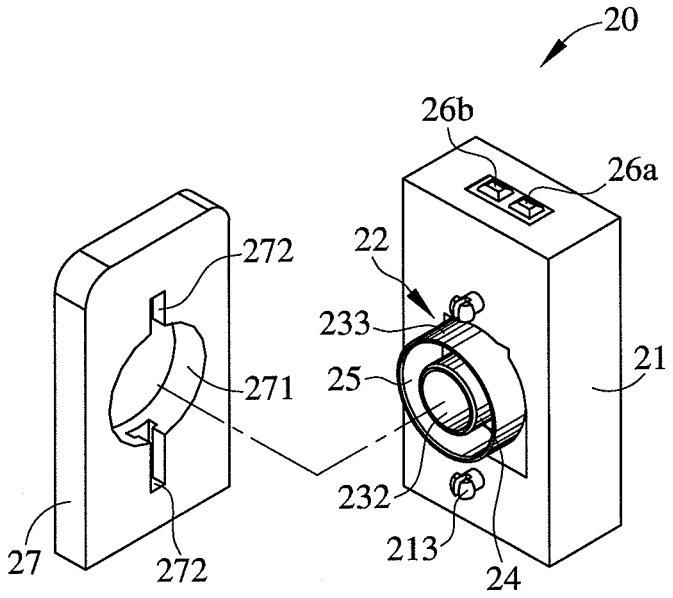
FIG. 3 is a perspective partially exploded view of the slide contact assembly of the array speaker structure of the present invention.
Figure 4:
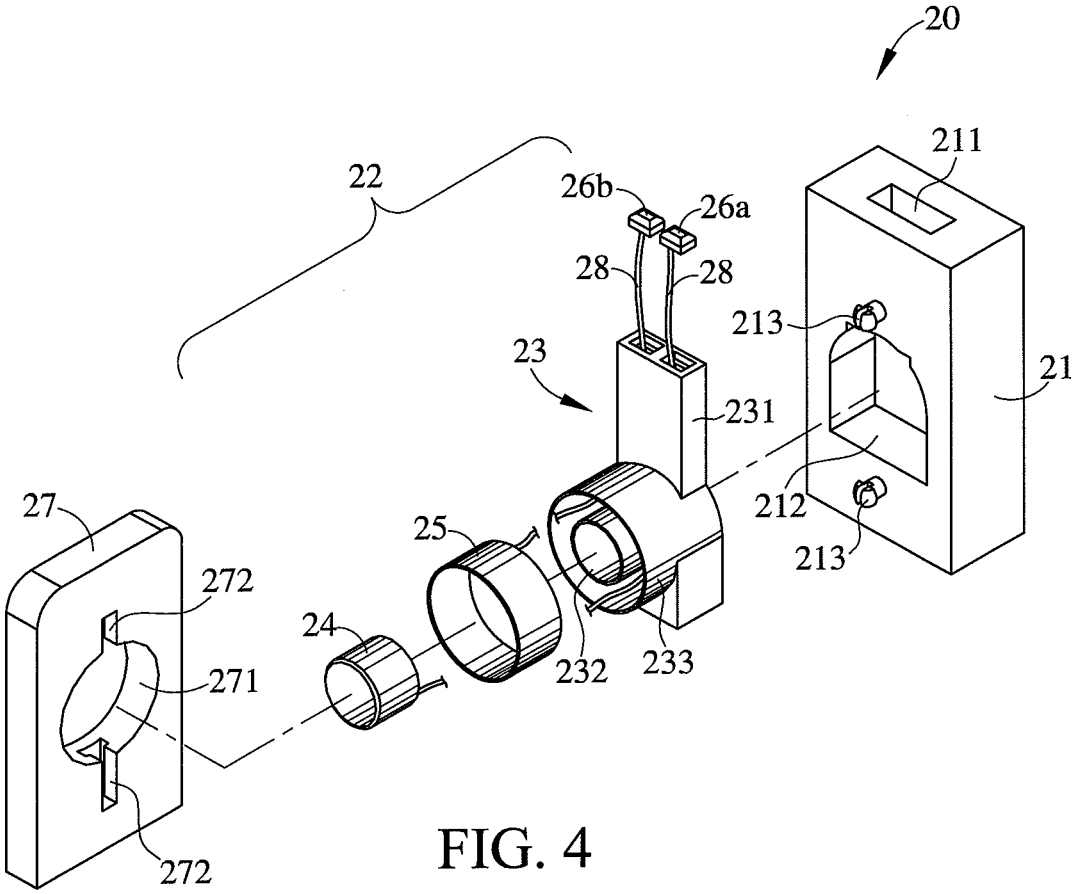
FIG. 4 is a perspective exploded view of the slide contact assembly of the array speaker structure of the present invention.
Figure 5:
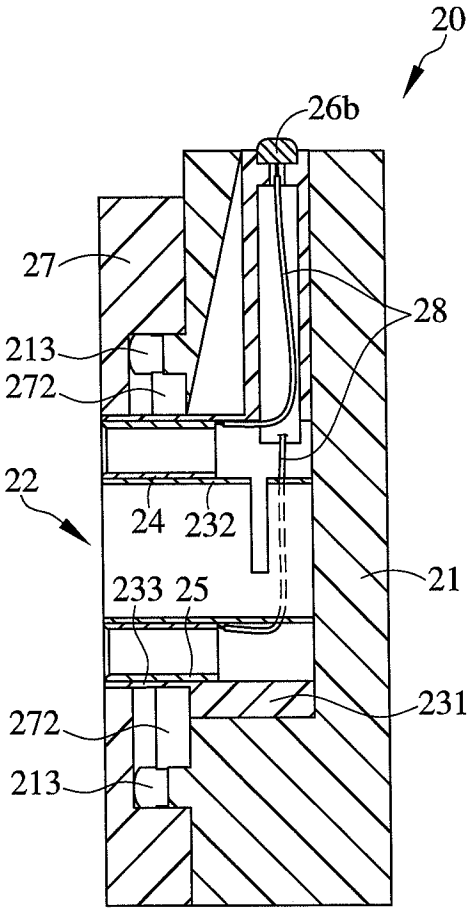
FIG. 5 is a sectional view of the slide contact assembly of the array speaker structure of the present invention.

As shown in FIGS. 3, 4 and 5, the slide contact assembly 20 includes a support body 21, a first conductive assembly 22 and an end board 27. The support body 21 has a longitudinal receiving cavity 211 and a transverse receiving cavity 212 in communication with the longitudinal receiving cavity 211. The support body 21 further has a pair of tenons 213 spaced from each other and positioned at upper and lower end sections of the transverse receiving cavity 212.

Figure 6:
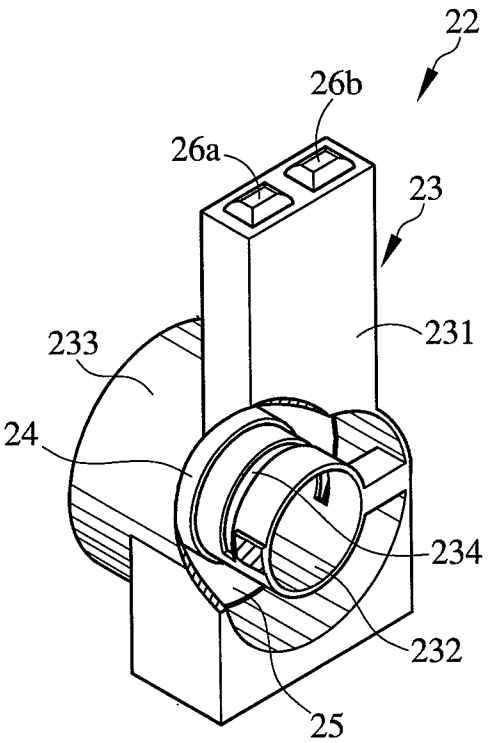
FIG. 6 is a perspective view of the slide contact assembly of the array speaker structure of the present invention, seen in another direction.

The first conductive assembly 22 has an insulation seat 23, a first inner conductive ring 24, a first outer conductive ring 25 and a pair of conductive members 26*a*, 26*b*. The insulation seat 23 has a base section 231 and an inner sleeve 232 and an outer sleeve 233 coaxially outward extending from the base section 231. The first inner conductive ring 24 is coaxially disposed around the inner sleeve 232, while the first outer conductive ring 25 is coaxially disposed in the outer sleeve 233. An arched slot 234 is circumferentially formed on the inner sleeve 232 (as shown in FIG. 6) with an arc angle of 180 degrees, and preferably 220 degrees.

The pair of conductive members 26*a*, 26*b* is disposed at a top end of the base section 231 and electrically connected to the first inner conductive ring 24 and the first outer conductive ring 25 via two wires 28 respectively. The base section 231 of the insulation seat 23 is placed into the transverse receiving cavity 212 and upward extended along the longitudinal receiving cavity 211 until the base section 231 is totally received in the longitudinal receiving cavity 211 and the transverse receiving cavity 212.

The end board 27 has a central hole 271 for receiving the outer sleeve 233 and a pair of mortises 272 radially extending from the central hole 271 corresponding to the pair of tenons 213. The tenons 213 can be inserted into the mortises 272 to connect the end board 27 onto the support body 21 and thus prevent the insulation seat 23 from slipping out of the transverse receiving cavity 212 of the support body 21.

Figure 7:
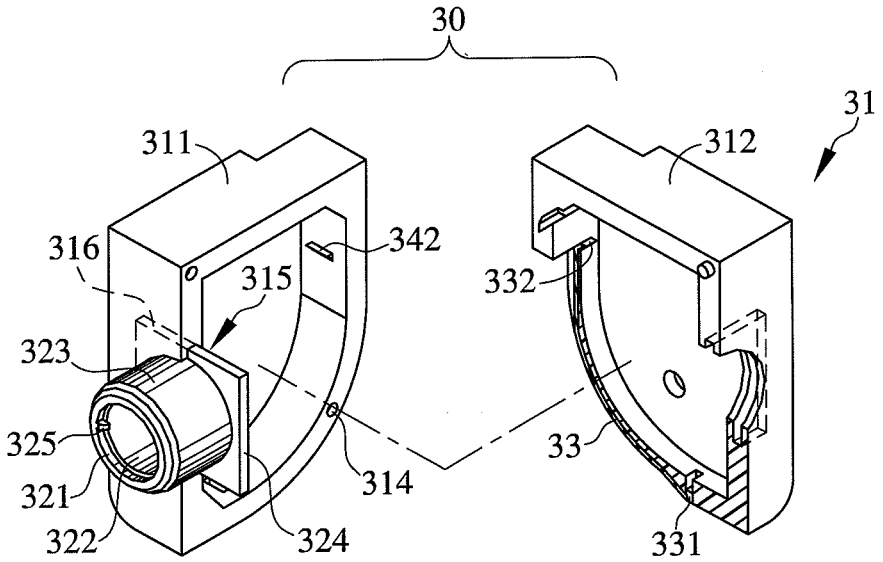
FIG. 7 is a perspective partially exploded view of the connector of the array speaker structure of the present invention.
Figure 8:
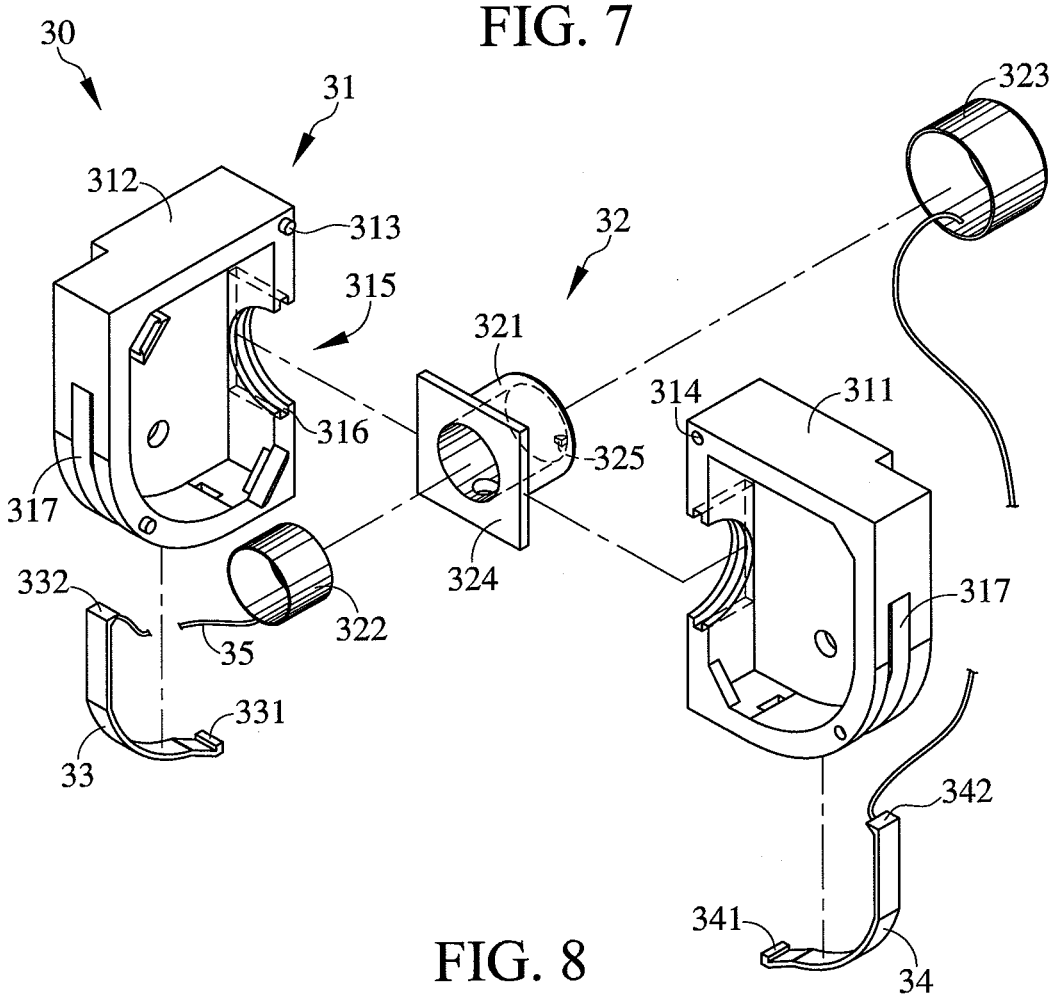
FIG. 8 is a perspective exploded view of the connector of the array speaker structure of the present invention.
Figure 9:
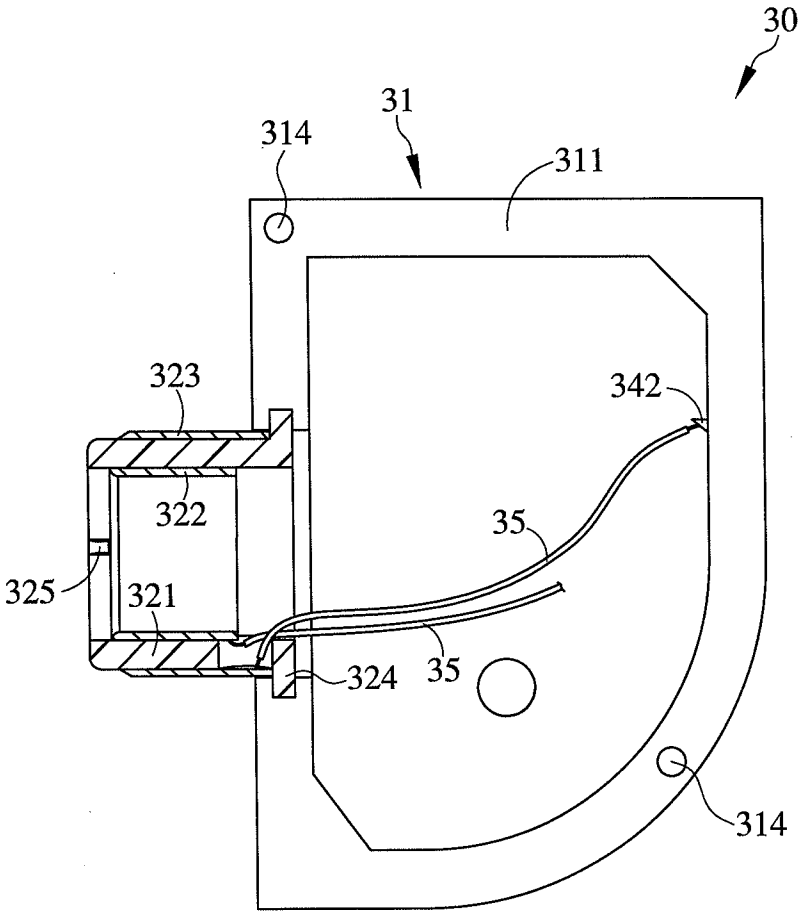
FIG. 9 is a sectional view of the connector of the array speaker structure of the present invention.

As shown in FIGS. 7, 8 and 9, the connector 30 includes a housing 31, a second conductive assembly 32 and a pair of conductive plates 33, 34. The housing 31 is composed of a first casing 311 and a second casing 312. The first and second casings 311, 312 are connected with each other by means of engagement structures such as insertion pins 313 and insertion holes 314. The housing 31 has a receiving hole 315 facing the end board 27 of FIG. 3. The first casing 311 is formed with a semicircular notch and the second casing 312 is also formed with a semicircular notch. The semicircular notches are mated with each other to together form the receiving hole 315. A circumferential wall of the receiving hole 315 is formed with a rectangular sink 316. The housing 31 has a pair of arched grooves 317 respectively formed on rear walls of the first and second casings 311, 312 opposite to the receiving hole 315. Each of outer wall faces of the first and second casings 311, 312 is formed with a movement section 318 (as shown in FIG. 2).

The second conductive assembly 32 includes an insulation sleeve 321 extending out of the housing 31, a second inner conductive ring 322 coaxially disposed on an inner circumference of the insulation sleeve 321 and a second outer conductive ring 323 coaxially disposed on an outer circumference of the insulation sleeve 321. A rear end of the insulation sleeve 321 has a rectangular member 324 positioned in the rectangular sink 316 of the receiving hole 315, whereby the insulation sleeve 321 cannot be freely rotated within the receiving hole 315.

The pair of conductive plates 33, 34 is disposed on the housing 31 and positioned in the arched grooves 317 of the first and second casings 311, 312 respectively. The conductive plates 33, 34 are electrically connected to the second inner conductive ring 322 and the second outer conductive ring 323 via wires 35 respectively. Two ends of each of the conductive plates 33, 34 are respectively formed with a fixed end section 331, 341 and a connection end section 332, 342. The fixed end sections 331, 341 and the connection end sections 332, 342 are inserted in upper and lower slits of the arched grooves 317 so as to securely mount the conductive plates 33, 34 in the arched grooves 317.

Figure 10:
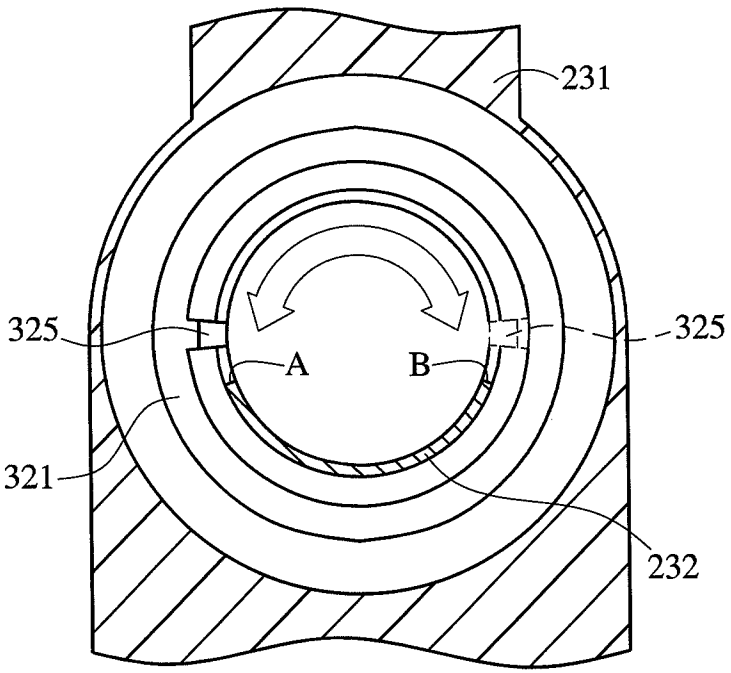
FIG. 10 is a sectional view showing that when the connector of the present invention is rotated, the slide member of the insulation sleeve is moved from one end of the arched slot of the inner sleeve to the other end thereof.

A slide member 325 is disposed on the inner circumference of a free end of the insulation sleeve 321 and positioned in the arched slot 234 of the inner sleeve 232 of the first conductive assembly 22. The slide member 325 is movable from one end A of the arched slot 234 to the other end B thereof (as shown in FIG. 10). Accordingly, the connector 3 can be only forward rotated by a predetermined angle.

Figure 11:
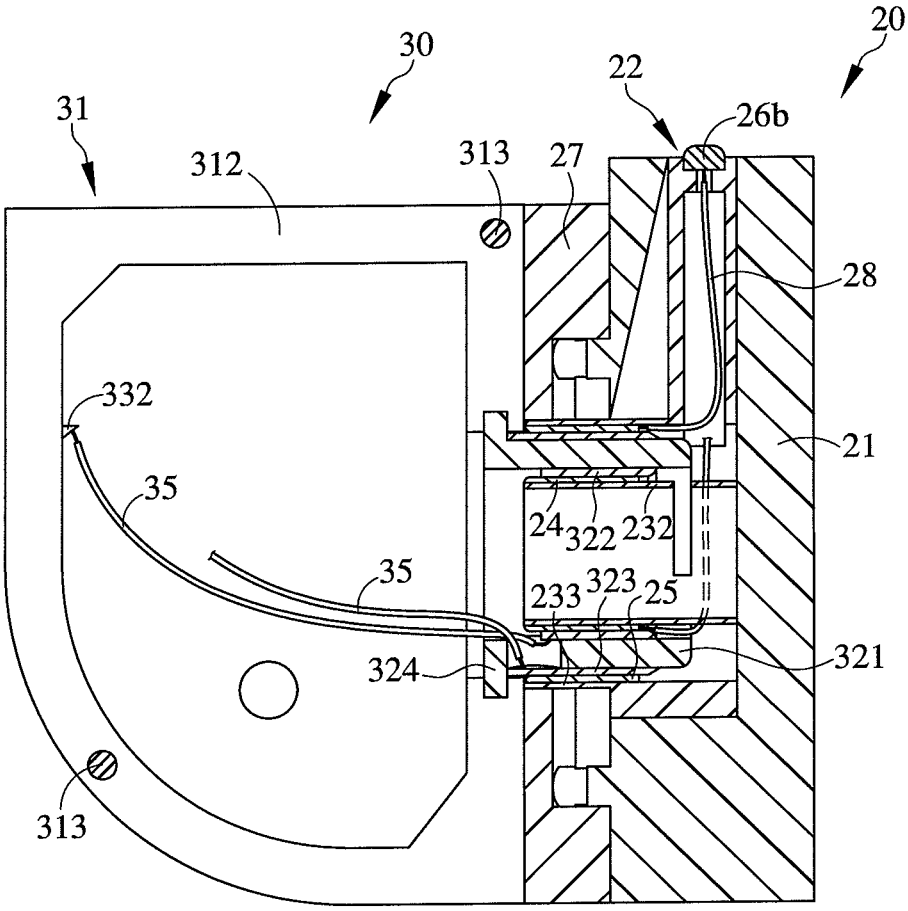
FIG. 11 is a sectional assembled view of the slide contact assembly and the connector of the array speaker structure of the present invention.

As shown in FIG. 11, when the second conductive assembly 32 of the connector 30 is totally inserted into the first conductive assembly 22 of the slide contact assembly 20, the second inner conductive ring 322 is coaxially positioned around the first inner conductive ring 23 in electrical contact therewith and the second outer conductive ring 323 is coaxially positioned in the first outer conductive ring 25 in electrical contact therewith. According to the above assembly and the electrical connection relationship, the conductive members 26*a*, 26*b* are electrically connected to the conductive plates 33, 34 respectively.

As shown in FIGS. 1 and 2, the array speaker unit 40 includes a speaker box 41, multiple speakers 42 installed in the speaker box 41 and a pair of leaf springs 43 disposed at a rear end of the speaker box 41 in electrical contact with the conductive plates 33, 34 of the connector 30 respectively and in electrical (positive and negative electrodes) connection with the speakers 42. Each leaf spring 43 has a fixed end connected with wall face of the speaker box 41 and a free end.

A pair of lugs 44 outward extends from the rear end of the speaker box 41 and is positioned on outer sides of the pair of leaf springs 43. A pivot pin 45 is disposed on inner wall face of each lug 44 for connecting with the housing 31 of the connector 30. Accordingly, the lugs 44 of the array speaker unit 40 can be rotated within the movement sections 318 of the housing 31 around the pivot pins 45. The phantom lines of FIG. 1 show that when the array speaker unit 40 is not rotated to the front side of the tablet 50, the array speaker unit 40 can be only downward rotated to a predetermined position.

Figure 12A:
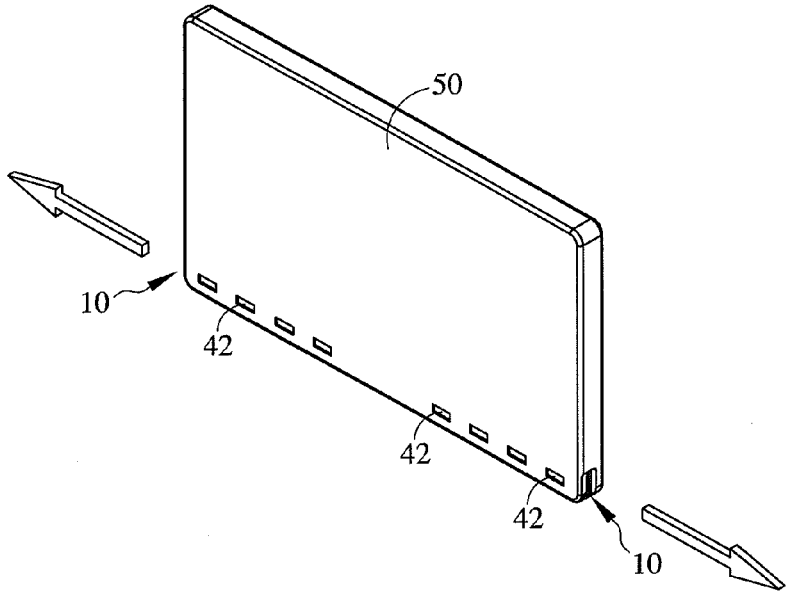
FIGS. 12A to 12E respectively show that the array speaker structure of the present invention is extended, rotated and lifted to the lateral side of the audio/video device.

FIGS. 12A to 12E show the positions and relationship between the array speaker structure 10 and the audio/video device such as the tablet 50 when the array speaker structure 10 is extended, rotated and lifted. The array speaker structure 10 is inlaid in the bottom section of the tablet 50 in a retracted position. In this mode, the speakers 42 are positioned on the back side of the tablet 50 to emit sound from the back side thereof as shown in FIG. 12A.

Figure 12B:
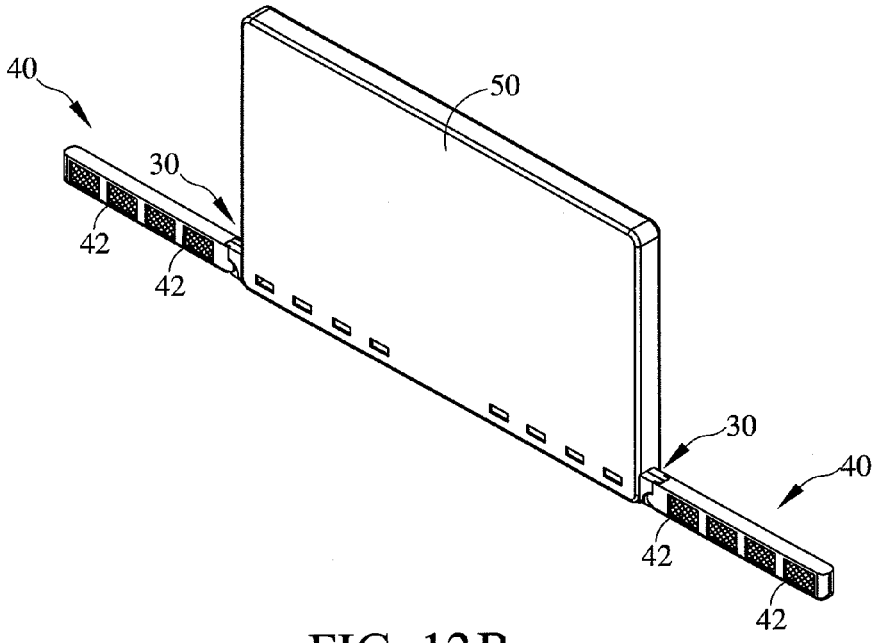
Figure 12C:
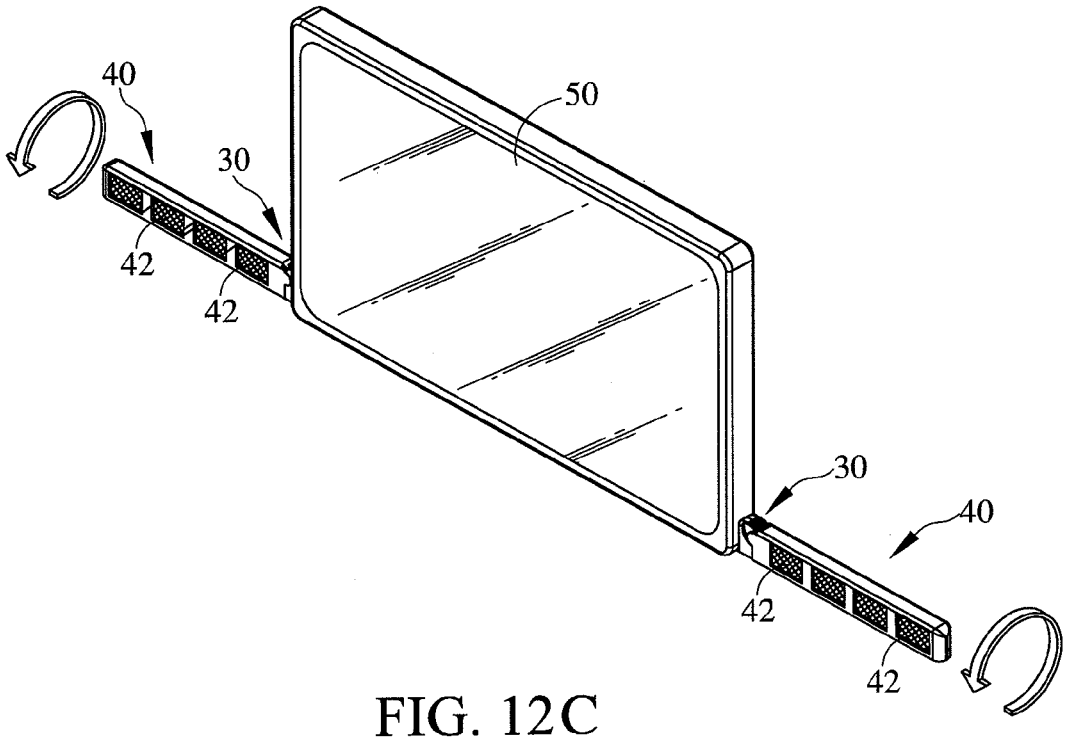
Figure 12D:
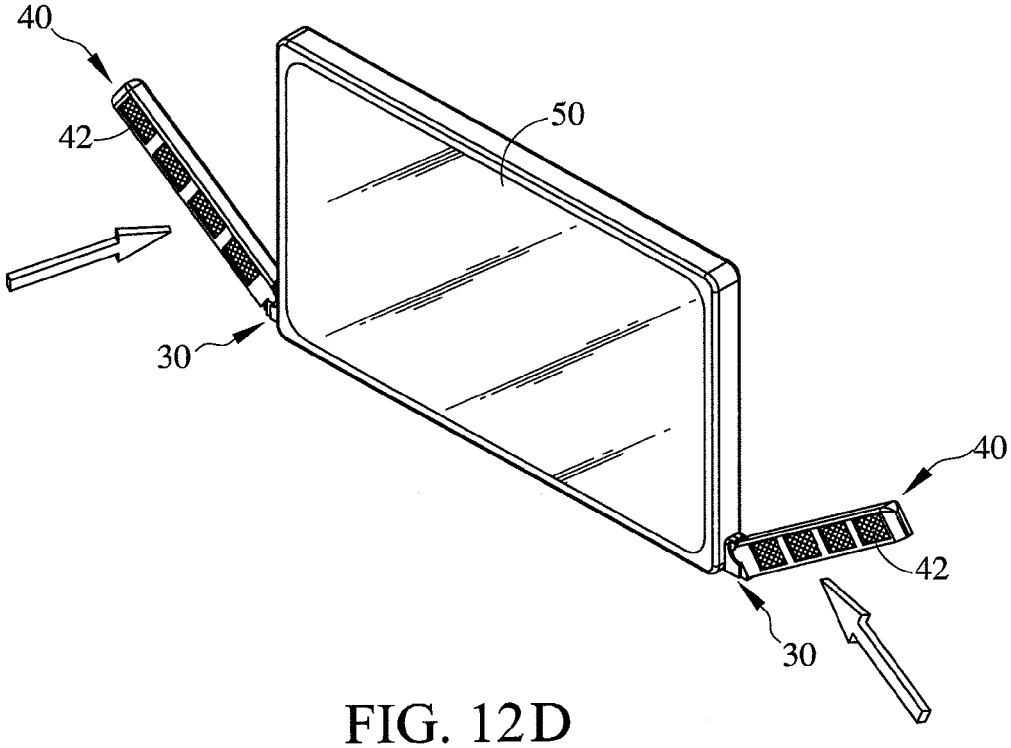
Figure 12E:
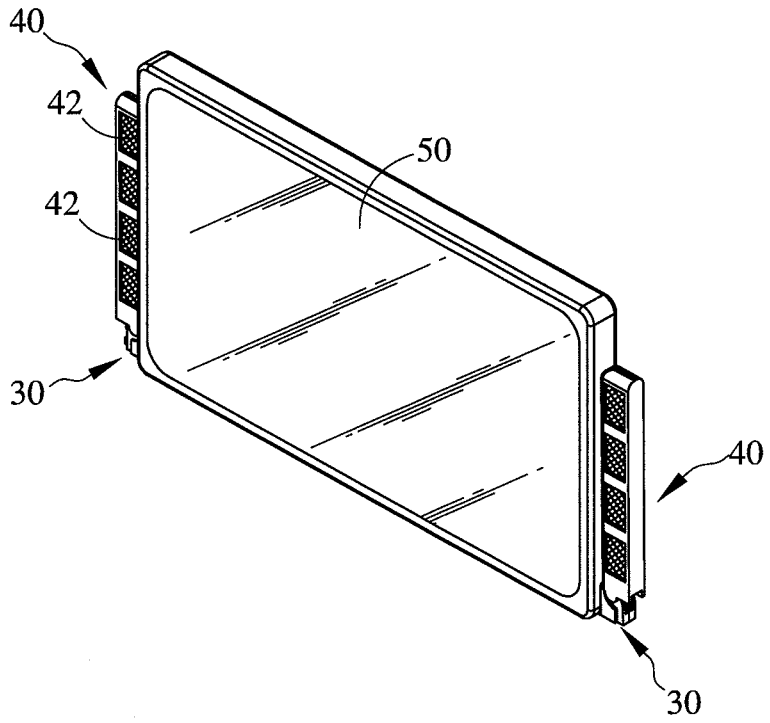

In an audio/video multimedia mode, the array speaker unit 40 is drawn out or extended out of the tablet 50 by means of a pop-up mechanism as shown in FIG. 12B. Then the array speaker unit 40 is 180-degree rotated to the front side of the tablet 50 as shown in FIG. 12C. Finally, the array speaker unit 40 is rotated upward until the array speaker unit 40 is attached to the lateral side of the tablet 50 as shown in FIGS. 12D and 12E. Under such circumstance, the speakers 42 can emit sound from the front side of the tablet 50.

In conclusion, by means of operating the array speaker unit 40 of the present invention, the speakers can emit sound right toward a user. Each array speaker unit is composed of four speakers and there is an array speaker unit on either side. Therefore, the sound can be more widely broadcast to achieve better listening quality. Also, the left and right channels can provide a surrounding stereo sound effect for a user The present invention has been described with the above embodiment thereof and it is understood that many changes and modifications in the above embodiment can be carried out without departing from the scope and the spirit of the invention that is intended to be limited only by the appended claims.

What is claimed is:

1. An array speaker structure for audio/video device, the array speaker structure being installed in a bottom section of the audio/video device, the array speaker structure comprising:

a slide contact assembly movable from a first position to a second position within an interior of the audio/video device along a longitudinal direction thereof, the slide contact assembly including a pair of conductive members constantly in electrical connection with the audio/video device, the slide contact assembly further including a first conductive assembly having an insulation seat, the insulation seat having an inner sleeve and an outer sleeve coaxially outward extending from the insulation seat, a first inner conductive ring coaxially disposed around the inner sleeve and a first outer conductive ring coaxially disposed in the outer sleeve, the first inner conductive ring and the first outer conductive ring being respectively electrically connected to the conductive members;

a connector connected with the slide contact assembly and rotatable within a predetermined angular range, the connector including a housing and a second conductive assembly mounted in the housing, the second conductive assembly including an insulation sleeve extending out of the housing and inserted between the inner and outer sleeves of the slide contact assembly, a second inner conductive ring coaxially disposed on an inner circumference of the insulation sleeve and positioned around the first inner conductive ring in electrical contact therewith and a second outer conductive ring coaxially disposed on an outer circumference of the insulation sleeve and positioned in the first outer conductive ring in electrical contact therewith; and an array speaker unit rotatably connected with the housing of the connector, multiple speakers being arranged in the array speaker unit and positioned on a back side of the audio/video device, the speakers being electrically connected to the second inner conductive ring and the second outer conductive ring of the connector, via the slide contact assembly, the array speaker unit being extendable out of the audio/video device, by means of operating the connector, the speakers being rotatable to face a front side of the audio/video device, whereby the speakers can emit sound from the front side of the audio/video device.

2. The array speaker structure as claimed in claim 1, wherein the slide contact assembly further includes a support body and an end board assembled and connected with the support body, the support body having a receiving cavity for receiving the first conductive assembly, the end board having a central hole for receiving the outer sleeve.

3. The array speaker structure as claimed in claim 1, wherein an arched slot is circumferentially formed on the inner sleeve.

4. The array speaker structure as claimed in claim 3, wherein a slide member is disposed on the inner circumference of one end of the insulation sleeve and positioned in the arched slot of the inner sleeve, whereby the slide member is movable within arched slot.

5. The array speaker structure as claimed in claim 1, wherein the insulation seat has a base section, the inner sleeve and outer sleeve outward extending from the base section, the pair of conductive members being disposed at a top end of the base section.

6. The array speaker structure as claimed in claim 1, wherein the housing of the connector is composed of a first casing and a second casing.

7. The array speaker structure as claimed in claim 1, wherein each of two lateral outer wall faces of the housing is formed with a movement section, a pair of lugs outward extending from the array speaker unit, the pair of lugs being rotatable within the movement sections, whereby the array speaker unit can be lifted to a lateral side of the audio/video device in a predetermined direction.

8. The array speaker structure as claimed in claim 1, wherein a pair of conductive plates are disposed on the housing of the connector and respectively electrically connected to the second inner conductive ring and the second outer conductive ring.

9. The array speaker structure as claimed in claim 8, wherein a pair of leaf springs is disposed on the array speaker unit in electrical contact with the pair of conductive plates.

10. The array speaker structure as claimed in claim 9, wherein the array speaker unit includes a speaker box for receiving the multiple speakers, the pair of leaf springs being electrically connected to the speakers.

* * * * *